United States Patent [19]

Berg

[11] 4,202,405

[45] May 13, 1980

[54] AIR COOLED CONDENSER

[75] Inventor: William F. Berg, Houston, Tex.

[73] Assignee: Hudson Products Corporation, Houston, Tex.

[21] Appl. No.: 483,145

[22] Filed: Jun. 26, 1974

Related U.S. Application Data

[63] Continuation-in-part of Ser. No. 291,673, Sep. 25, 1972, abandoned.

[51] Int. Cl.[2] ..... F28B 1/06

[52] U.S. Cl. ..... 165/110; 165/111; 165/122; 165/176; 165/DIG. 13

[58] Field of Search ..... 165/110, 111, 122, 176, 165/DIG. 13

[56] References Cited

U.S. PATENT DOCUMENTS

| | | | |
|---|---|---|---|
| 1,917,042 | 7/1933 | Lewis et al. | 165/176 |
| 2,401,918 | 6/1946 | Elder et al. | 165/122 |
| 2,743,088 | 4/1956 | Laubach | 165/122 |
| 2,826,395 | 3/1958 | Petty | 165/39 |
| 3,231,013 | 1/1966 | Heller et al. | 165/176 X |
| 3,262,497 | 7/1966 | Worthen et al. | 165/176 |
| 3,424,235 | 1/1969 | Schoonman | 165/110 |
| 3,556,204 | 1/1971 | Dehne | 165/111 |
| 3,705,621 | 12/1972 | Schoonman | 165/124 X |
| 3,707,185 | 12/1972 | Modine et al. | 165/122 X |
| 3,734,176 | 5/1973 | Hagnauer | 165/176 X |
| 3,814,177 | 6/1974 | Harris et al. | 165/110 |

FOREIGN PATENT DOCUMENTS

| | | | |
|---|---|---|---|
| 968430 | 9/1964 | United Kingdom | 165/122 |

*Primary Examiner*—Sheldon Richter
*Attorney, Agent, or Firm*—Marvin B. Eickenroht; Jennings B. Thompson

[57] ABSTRACT

There is disclosed an air cooled condenser comprising a tube bundle having rows of tubes arranged to be successively contacted by cooling air, an inlet header at one end of the bundle connected to the tubes of one of the outermost rows and the row adjacent thereto, an outlet header at the one end of the bundle connected to the tubes of the other outermost row and the row adjacent thereto, and means at the other end of the bundle connecting the tubes of the outermost rows to one another and the tubes of the adjacent rows to one another.

3 Claims, 6 Drawing Figures

10
11
12
13
14
15
17
18
19
20
21
22
22A
23
24
25
33
34
35
36
36A
2
3
4

AIR COOLED CONDENSER

This application is a continuation-in-part of Ser. No. 291,673, filed Sept. 25, 1972, and entitled "Air Cooled Condenser," now abandoned.

This invention relates generally to air cooled condensers; and, more particularly, to improvements in air cooled condensers for condensing steam or other substantially single component vapor at a pressure near or below atmospheric, such as vacuum steam from a turbine exhaust.

In air cooled condensers of this type, the tube rows are arranged in a single pass—i.e., connected in parallel with inlet and outlet headers at their opposite ends. Thus, it has not been the practice to arrange the tube rows in more than one pass because of the pressure drop limitations. That is, multiple pass arrangement would necessitate shorter tubes and thus more headers, resulting in greater construction costs.

With successive rows of the tubes of a single pass condenser arranged in the direction of air flow, the temperature of the cooling air rises as it flows past them so that there is a drop in the temperature differential between the air and the steam or other vapor within the tubes of successive rows. Therefore, initially at least, unequal amounts of steam will condense in the tubes of the rows, with the greatest amount condensing in the tubes of the rows first to be contacted by the air and successively lesser amounts condensing in the tubes of the rows successively contacted by the air.

However, since the tubes of the first row to be contacted by the air are capable of condensing more vapor than the tubes of the other rows, they would draw some steam from the tubes of successive rows, and primarily from the last row to be contacted by the air. The same would be true, to a lesser extent, of the tubes of successive rows up to the last row. As well known in the art, vacuum steam carries along with it a small amount of air and other non-condensibles, and since steam would enter the tubes of the rows at both ends, it would, upon condensing, leave the non-condensibles trapped within such tubes.

Over a period of time, the increasing build-up of air in the tubes would lower the partial pressure of the steam therein and thus its saturation temperature. Also, the condensing film coefficient inside of these tubes would be lowered considerably due to the blanketing of the inner surfaces of the tubes with the non-condensibles. If these conditions were permitted to continue, the tubes of the first row, and to a lesser extent the tubes of successive rows up to the last row, would condense less and less steam. Eventually then, the tubes of all rows would be condensing the same amount of steam that the tubes of the last row are capable of condensing, thereby resulting in a very inefficient operation.

Also, in the event the condenser is used to condense vacuum steam from a turbine exhaust, and is designed for a certain performance at an elevated ambient temperature, it's necessary to reduce the velocity of air flow past the tubes during extremely low ambient temperatures in order to maintain the minimum back pressure needed for the turbine operation. This results in a corresponding increase in the rise of air temperature across the bundle and ultimately a much greater build-up of air and other non-condensibles within the tubes of the first row, and to a lesser extent in the tubes of successive rows up to the last row. As a result, the partial pressure of the steam in these tubes, and thus its saturation temperature, may be so depressed that, in combination with the low ambient air temperature, the condensate may freeze and cause the tubes of at least the first row to burst.

In view of these problems, efforts have been made to design an air cooled condenser in which equal amounts of steam are condensed in the tubes of all of the rows. However, none of these provide a completely satisfactory answer to the problems. For example, the condenser shown in Fritzberg U.S. Pat. No. 2,587,720 would be very expensive to build due to its bent finned tubes. Also, the condensers shown in Schulenberg U.S. Pat. No. 3,223,152 would provide equal condensation only for given temperature conditions, and, in any event, would be expensive to build due to their use of specially constructed finned tubes for each row. Still further, the condenser shown in Gunter U.S. Pat. No. 3,543,843 sacrifices condensing capability due to its use of tubes having bare - or unfinned - lengths.

It has also been the practice to so design the condenser that the tubes of all its rows receive only the amount of steam which those of the first row are capable of condensing, and to draw off excess steam from succeeding rows to a so-called vent condenser connected in series with the main condenser. For summer operations, the amount of steam required to be drawn off from the condenser to insure that all rows of tubes remain free of stagnant air, may be from ten to fifty percent of the entire steam to be condensed; and, as the ambient air temperature decreases during the winter, even a larger percent should be drawn off. Since the vent condenser is of the same construction as the main condenser, and thus susceptible to the same shortcomings as the main condenser, the use of the vent condenser is of relatively minor benefit from the standpoint of the efficiency of the overall condenser apparatus, particularly in view of the necessity for additional headers for the separate condensers. Also, of course, a very substantial percentage of the tube lengths are still susceptible to freezing.

An object of this invention is to provide an air cooled condenser which is much more efficient than the above-noted condenser apparatus.

Another object is to provide an air cooled condenser in which a considerably lesser percentage of tube lengths are susceptible to freezing than in prior air cooled condenser apparatus.

Still another object is to provide such an air cooled condenser whose operation may be adjusted, and whose tubes may be so arranged that, during low ambient temperature conditions, there is even less likelihood of freeze-up.

A further object is to provide such a condenser which is relatively simple and inexpensive to construct.

These and other objects are accomplished, in accordance with the illustrated embodiments of the present invention, by an air cooled condenser having means for introducing the steam or other vapor to be condensed into the tubes of one of the outermost rows and the row adjacent to it at one end of the bundle, means connecting the tubes of the outermost rows to one another and the tubes of the rows adjacent to the outermost rows to one another at the other end of the bundle, and means for discharging condensate from the tubes of the other outermost row and the row adjacent to it at the one end of the bundle. As a result, it is possible, over a broad range of operating conditions, to maintain the total amount of steam condensed in the tubes of the interconnected outermost rows more nearly equal to that condensed in the tubes of the adjacent rows than is possible when the tubes of all rows are connected in parallel, as in the present air cooled condenser apparatus. As a result, a much lesser amount of steam must be bypassed in order to eliminate air and other non-condensibles within the tubes of the condenser, as a result of which the size of the vent condenser and its resulting inefficiency may be maintained at a minimum.

More particularly, inlet and outlet headers at one end of the tube bundle connect, respectively, with the tubes of the one outermost row and the row adjacent to it and with the tubes of the other outermost row and the row adjacent to it. The tubes of the outermost row to which the inlet header is connected are either the first or the last to be contacted by the air, depending on the direction of air flow.

Preferably, a pair of tube bundles are mounted generally horizontally and in end-to-end relation with the housing. In one embodiment, the inlet and outlet headers of the tube bundles are arranged end-to-end, with all being contained in a single duct and with condensate being introduced to each through a common chamber in the duct. In other embodiments of the invention, the other ends of the bundles are arranged end-to-end, and having their outermost rows connected with one another through a common chamber of a header between such ends. In one of the latter embodiments, the inlet and outlet headers are mounted in end-to-end relation with inlet and outlet headers of similar side-by-side air cooled condensers, and all such headers are contained in a single duct, as above described.

The means for connecting the tubes at the other end of the bundle may comprise a header having a wall dividing it into chambers, one of which connects the tubes of the outermost rows with one another and the other of which connects the tubes of the adjacent rows with one another. Alternatively, each tube of one outermost row may be connected to a tube of the other outermost row by a bent tube, and each tube of one adjacent row may be connected to a tube of the other adjacent row by another bent tube.

In the preferred and illustrated embodiment of the invention, air flow past the tube bundle is induced by a fan having blades whose pitch may be reversed. Thus, for example, during normal operations, the pitch of the blades may be adjusted in such a manner as to cause air flow upwardly past the tubes in order that the coolest ends thereof adjacent the outlet header are the first to be contacted by the air. Then, in the event of very low ambient temperature conditions, the pitches of the blades may be adjusted to reverse the air flow and thus cause the coolest ends of the tubes to be the last to be so contacted. Since the temperature differential between the air and the vapor being condensed in these tubes is at a minimum, there is less chance of freeze-up.

Also, the tubes of the tube bundle are adapted to be arranged generally horizontally, with the tubes of the rows which are connected to the inlet header being inclined downwardly in a direction away from the inlet header, and the tubes of the rows which are connected to the outlet header being inclined downwardly in a direction toward the outlet header. In this way, all tubes slope downwardly in the direction of flow through them to permit free drainage and further reduce the possibility of freezing of condensate in the tubes, whether in or out of operation.

In the drawings, wherein like reference characters are used throughout to designate like parts:

FIG. 7 is a partial, vertical section view of apparatus in which three air cooled condensers constructed in accordance with another embodiment of the present invention are arranged in side-by-side relation;

FIG. 8 is an enlarged, vertical section view of a part of one of the condensers of FIG. 7; and FIG. 9 is a vertical section view of an air cooled condenser constructed in accordance with still another embodiment of the present invention.

Figures 1, 2, 3:
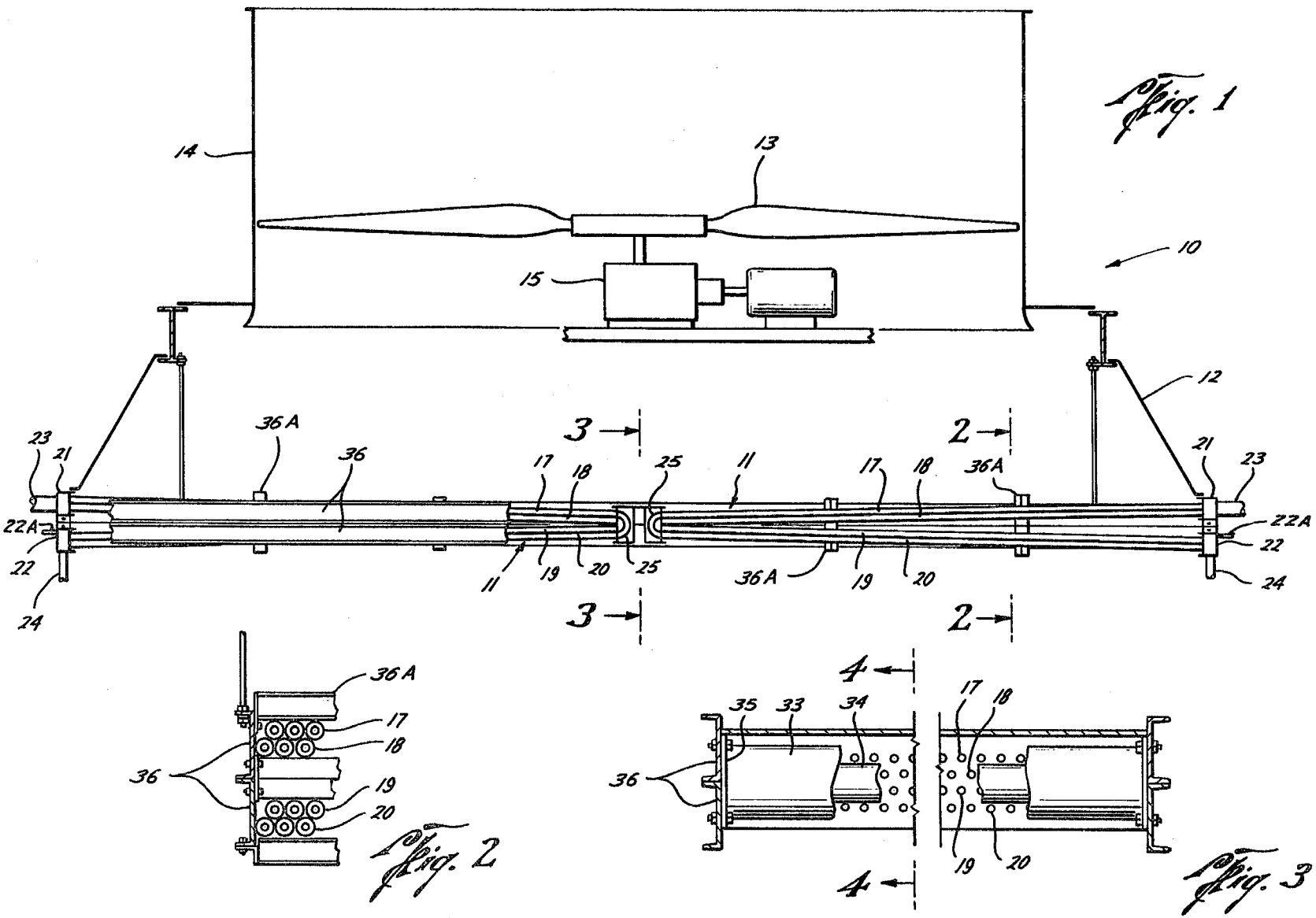
FIG. 1 is a vertical sectional view of an air cooled condenser constructed in accordance with one embodiment of the present invention, and with certain parts thereof broken away for illustrative purposes.
FIG. 2 is an enlarged cross-sectional view of a part of the condenser, as seen along broken lines 2—2 of FIG. 1.
FIG. 3 is another enlarged cross-sectional view of the condenser, as seen along broken line 3—3 of FIG. 1.

With reference now to the details of the above-described drawings, and with particular reference to FIG. 1, the overall air condenser constructed in accordance with the first-mentioned embodiment, which is indicated in its entirety by reference character 10, includes a pair of generally horizontal tube bundles 11 arranged end-to-end within a shroud 12, and a fan 13 mounted within a fan ring 14 above the upper end of the shroud. The fan ring and shroud form a housing open at its upper and lower end and through which air flow is induced past the tubes of the bundles 11. The fan is driven by any suitable mechanism 15, which, as above noted, includes means for reversing the pitch of the blades of the fan 13, whereby air can be caused to flow across the tube bundles in either an upward direction or a downward direction. Although the illustrated condenser 10 includes a pair of end-to-end tube bundles, it is obvious that only a single bundle, or, for that matter, three or more end-to-end bundles may be provided. Also, of course, the bundles may be arranged vertically of one another and/or side-by-side.

As shown, each bundle includes longitudinally extending finned tubes 16 arranged in four vertically disposed rows 17, 18, 19 and 20, with the outermost rows 17 and 20 being on the top and bottom, respectively, of the bundles and the rows 18 and 19 being adjacent the rows 17 and 18, respectively. As indicated in FIG. 2, and as well known in the art, each row includes a plurality of tubes 16 arranged side-by-side from one side to the other of the bundle.

The steam or other vapor to be condensed is introduced into the outer ends of the tubes of the top row 17 and row 18 adjacent thereto by means of a header 21, and condensate is removed from the outer ends of the tubes of the bottom row 20 and the row 19 adjacent to it into a header 22. Steam is fed to the inlet header 21 by means of a conduit 23, which may lead from the exhaust of a steam turbine, and condensate from outlet header 22 flows into a conduit 24, which may lead to a boiler or other suitable place of disposal. There are vents 22A in each outlet header for connection with a vent condenser (not shown), in which uncondensed steam may be condensed.

Figure 4:
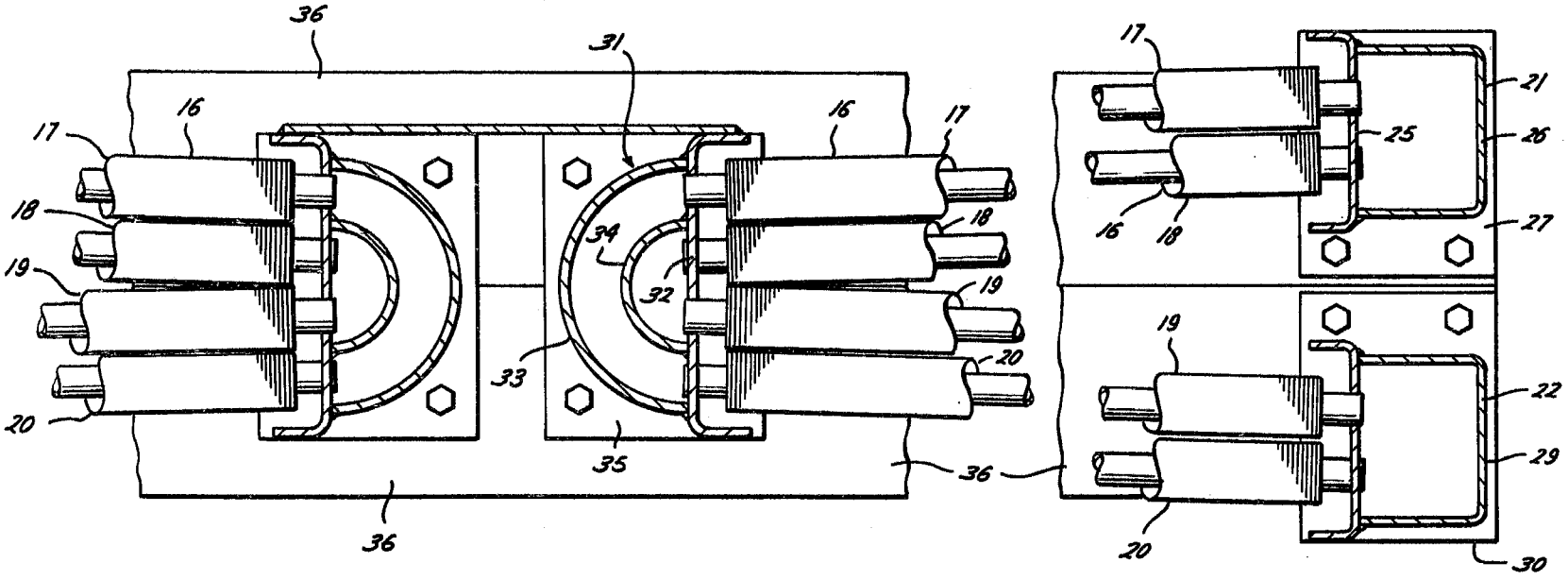
FIG. 4 is a further enlarged longitudinal sectional view of the condenser, as seen along broken line 4—4 of FIG. 3.

As shown in FIG. 4, header 21 includes a tube sheet 25 having holes through which the outer ends of the tubes of rows 17 and 18 extend, a U-shaped wall 26 secured to its outer side above and below such tube ends to form a chamber common to all of them, and plates 27 closing the opposite ends of the chamber. Header 22 similarly includes a tube sheet 28 having holes through which the outer ends of the tubes of rows 19 and 20 extend, a U-shaped wall 29 secured to the outer side of the tube sheet above and below the tubes to form a chamber common to all of them, and plates 30 closing the opposite ends of the chamber.

In the embodiment of the invention illustrated in FIGS. 1-4, the inner ends of the tubes of the top and bottom rows 17 and 20 and the inner ends of the tubes of the adjacent rows 18 and 19 of each bundle are connected to one another by means of a header 31. As shown in FIG. 4, each such header comprises a tube sheet 32 having holes to receive the inner ends of the tubes of all of the rows, an outer semi-circular wall 33, and an inner semi-circular wall 34 concentrically arranged within the outer wall. As shown, the upper and lower edges of the outer wall 33 are secured to the tube sheet above and below the tube ends of the top and bottom rows, and the upper and lower edges of the inner wall 34 are secured to the tube sheet between the tube ends of the rows 17 and 18 and the rows 19 and 20. More particularly, the tube sheet 32 and the curved walls 33 and 34 extend between plates 35 providing end walls for the header, so as to form separate chambers in the header which connect the tubes of the top and bottom rows to one another and the tubes of the adjacent rows to one another.

As also best shown in FIG. 4, the outer ends of the tubes of the rows 17 and 18 are above the inner ends thereof, and the outer ends of the tubes of the rows 19 and 20 are below the inner ends thereof. As a result, condensate passing through the tube bundle will flow downwardly from inlet header 21 to outlet header 22.

As best shown in FIG. 4, each bundle 11 is supported within the shroud 12 by channels 36 extending along its opposite sides. More particularly, the plates 27 and 30 on the opposite ends of headers 21 and 22 and the plates 35 on opposite ends of header 31 are bolted to the inner sides of the channels near their outer ends. In addition, the tubes may be supported intermediate their ends by cross members 36A extending laterally between the channels.

Figure 5:
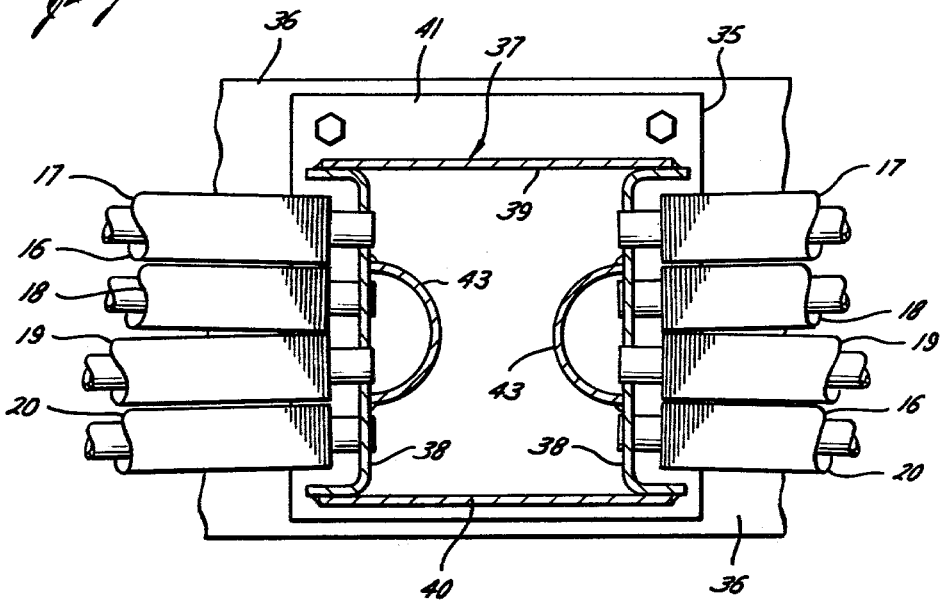
FIGS. 5 and 6 are additional further enlarged longitudinal sectional views, similar to FIG. 4, showing parts of alternative embodiments of the condenser.

As previously mentioned, the embodiment of the invention illustrated in FIG. 5 differs from that of FIGS. 1-4 in the manner in which the inner ends of the tubes of each bundle are connected to one another. Thus, the tubes are connected to one another by a single header 37, which, as in the embodiment of FIGS. 1-4, includes tube sheets 38 having holes through which the tubes of each bundle extend. The space between the tube sheets is enclosed by means of upper and lower walls 39 and 40 which, together with the tube sheets, extend laterally between side plates 41 at opposite ends of the bundles to enclose a chamber common to the tube ends of both bundles.

This chamber is divided into sub-chambers by a pair of walls 43, each of which is semi-circular in cross section, wit one such wall connecting to the tube sheet 31 of one bundle and the other such wall connecting with the tube sheet of the other bundle. More particularly, each wall 43 also extends laterally between plates 41 and is connected to the tube sheet above and below, respectively, the tube ends of the adjacent rows 18 and 19 of each bundle. Thus, the walls 43 define inner chambers connecting the inner ends of the tubes of these rows 18 and 19 of each bundle to one another, as well as an outer chamber connecting the tubes of the rows 17 and 20 of both bundles to one another. As shown in FIG. 5, the plates 41 are bolted to the channels 36 to support the inner ends of the bundles from the shroud.

Figure 6:
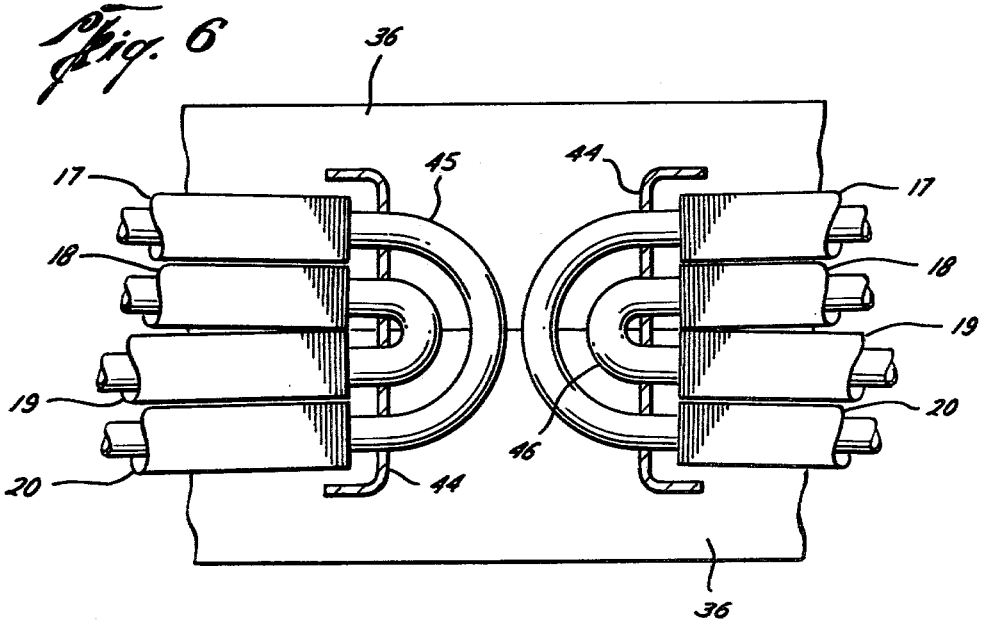

As also previously mentioned, the embodiment of the invention illustrates in FIG. 6 also differs from the first described embodiment of FIGS. 1 to 4 in the manner in which the ends of the tubes are connected to one another. Thus, as in the first two embodiments, the inner ends of the tubes of each bundle extend through holes in tube sheets 44 which are supported at their opposite ends by the channels 36. The ends of individual pairs of tubes which extend through the tube sheets are connected by bent tubes 45 and 46, with the tubes 45 being of a relatively large radius for connecting tubes of the top and bottom rows 17 and 20, and the tubes 46 being of a smaller radius for connecting the tubes of the adjacent rows 18 and 19. The bent tubes may comprise bent portions integral with the longitudinal tubes they connect, as shown, or they may comprise separate tubes welded or otherwise secured to the inner ends of the longitudinal tubes they connect.

The air cooled condenser constructed in accordance with the embodiment shown in FIGS. 7 and 8, and indicated in its entirety by reference character 50, includes, as in the case of the previously described embodiments, a pair of generally horizontally extending tube bundles 11 arranged end-to-end within a shroud 12, and a fan ring 13 mounted within a fan ring 14 above the shroud, the fan ring and shroud forming a housing which is open at its upper and lower ends and through which air flow is induced past the tube bundles. The fan is likewise driven by a motor 15, which, as in the previously described embodiment, includes means for reversing the pitch of the blades of the fan and thereby inducing air flow either upwardly or downwardly through the housing. As shown, and as will be described in more detail to follow, the condensers are mounted in side-by-side relation, with certain of their parts, to be described, being common to similar parts of an adjacent condenser.

As previously described, and as best shown in FIG. 8, each tube bundle includes longitudinally extending finned tubes 16 arranged in four vertically disposed rows 17, 18, 19 and 20, with the outermost rows 17 and 20 being on the top and bottom, respectively, and the rows 18 and 19 being adjacent to rows 17 and 18, respectively. As previously described in connection with FIG. 2, and as well known in the art, each row of tubes includes a plurality of tubes 16 arranged side-by-side from one side to the other of the bundle. As shown in FIG. 7, each tube bundle is suspended from a deck 51 on which the fan motor 15 is mounted by means of rods 52 having hooks on their lower ends which extend through brackets attached to channels 53 along opposite sides of the tube bundles.

As in the case of the previously described embodiments of the invention, the interconnected ends of the tubes are adjacent one another at the center of the housing, and the inlet and outlet headers on the opposite ends thereof are disposed adjacent the opposite ends of the bundles. More particularly, and as shown in FIG. 8, "U" bends 45 and 46 connect the tubes of the upper and lower rows 17 and 20 and the tubes of the adjacent rows 18 and 19, respectively, in the same manner shown in the embodiment of FIG. 6. These adjacent ends of the bundles are connected together by plates 54 which extend laterally between the channels 53 of each bundle having flanges 55 connected to one another, as by welding.

The unfinned ends of the tubes at the opposite ends of each bundle extend through a tube sheet 56 so as to connect with a duct 57 which extends laterally between the housings of adjacent condensers. More particularly, each duct has an opening in its opposite sides to receive the tube sheets of the condensers, and interior walls 59 which divide it into a large chamber 60 and a pair of small chambers 61. As best shown in FIG. 8, each such wall 59 includes a horizontal component extending laterally from a midpoint of the tube sheet 56 of one tube bundle, and a vertical component spaced a substantial distance from the vertical component of the other wall.

The large chamber 60 is common to the tubes of the uppermost row 17 and the adjacent row 18 of each bundle, while each of the small chambers 61 is connected to the tubes of lowermost row 20 and adjacent row 19 of one of the tube bundles. The common chamber 60 is in turn connected to a large steam distribution duct 58 extending laterally of the ducts 57, while each of the small chambers 61 connects with a condensate discharge outlet (not shown).

The condenser embodiment shown in FIG. 9, and indicated in its entirety by reference character 60, is similar in many respects to the previously described embodiments. Thus, it also includes a pair of generally horizontal tube bundles arranged end-to-end within a shroud 12, and a fan 13 mounted within a fan ring 14 above the upper end of the shroud, the fan ring and shroud forming a housing open at its upper and lower ends through which air flow is induced past the tubes of the bundles 11. Still further, a motor 15 is mounted in the housing beneath the fan for rotating the fan and selectively reversing the pitch of the blades thereof, so that air can be caused to flow upwardly or downwardly past the tube bundles.

Also, each bundle includes longitudinally extending finned tubes arranged in four vertically disposed rows 17, 18, 19 and 20, with the outermost rows 17 and 20 being on the top and bottom, respectively, and the rows 18 and 19 being adjacent the rows 17 and 18, respectively. Still further, and as previously described in connection with the other embodiments, each row includes a plurality of tubes arranged side-by-side from one side of the bundle to the other.

As compared with the previously described embodiments, however, the pair of tube bundles are reversed end-for-end—i.e., the interconnected tubes of the bundles are arranged adjacent the sides of the housing, and the ends for receiving vapor and discharging condensate are arranged adjacent one another in generally the central portion of the housing. However, as in the case of the embodiment of FIGS. 7 and 8, the inlet and outlet headers for the pair of tube bundles are disposed within a duct 57 having a large chamber 60 and a pair of smaller chambers 61. Opposite sides of the duct 57 may connect with tube sheets at the ends of the tube bundles, in the manner shown in FIG. 8. Similarly, as also described in connection with FIGS. 7 and 8, the large chamber 60 may connect with a large distribution duct for receiving steam to be introduced into the rows 17 and 18 of both bundles, while each of the smaller chambers 61 may connect with the rows 19 and 20 of each bundle.

Of course, it will be understood that in a large installation, the condensers shown in FIG. 1 to 6 and 9 may also be arranged in side-by-side relation, as shown in FIGS. 7 and 8. Furthermore, the condensers may be arranged in side-by-side relation in a transverse, as well as a longitudinal direction.

Although each tube bundle of all embodiments of the invention is shown to comprise only four successive rows of tubes, it will be understood that each bundle may include additional pairs of successive rows intermediate the adjacent rows 18 and 19. In such a case, the outer ends of the tubes of the additional rows nearest the top row would be connected to the steam inlet, the outer ends of the tubes of the additional rows nearest the bottom row would be connected to the condensate outlet, and the inner ends of the tubes of each additional row nearest the top would be connected to the inner ends of the tubes of a corresponding row nearest the bottom. For example, in a six row condenser, the outer ends of the tubes of the third row from the top would be connected to the stem inlet, the outer ends of the tubes of the fourth row from the top (or third row from the bottom) would be connected to the condensate outlet, and the inner ends of the tubes of the third and fourth rows from the top would be connected to one another.

During normal operation, the pitch of the blades of fan 13 would be so adjusted as to cause air to be drawn upwardly past the tube bundles 11, in which case the tubes of the bottom row 20 would be the first and the tubes of the top row 17 the last to be contacted by the air. However, during extremely cold weather, it may be desirable to reverse the pitch of the fan blades to cause the cool air to move downwardly over the tube bundles. As above described, this will cause the warmest air to flow past the bottom rows and thereby further reduce freezing possibilities.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. An air cooled condenser for condensing steam or other substantially single component vapor at a pressure near or below atmospheric, comprising a generally upright housing which is open at its upper and lower ends to permit air flow upwardly therethrough, at least one tube bundle mounted generally horizontally within the housing, each having vertically successive, generally horizontal rows of tubes arranged in the direction of air flow therepast, whereby the tubes of the lowermost and uppermost rows are respectively the first and last to be contacted by the air, and the tubes of the rows adjacent to those of each of the first and last to be contacted are the second and next to last to be contacted, respectively, an inlet header adapted to receive the vapor at one end of the bundle and connecting with the tubes of the uppermost row and the row adjacent thereto, a common outlet header at said one end of the bundle connecting directly with the tubes at the lowermost row and the row adjacent thereto for receiving condensate and uncondensed vapor therefrom, means at the other end of the bundle connecting the tubes of said lowermost and uppermost rows to one another and the tubes of said adjacent row to one another, and means for reversing the direction of air flow past the rows of tubes.

2. An air cooled condenser for condensing steam or other substantially single component vapor at a pressure near or below atmospheric, comprising a generally upright housing which is open at its upper and lower ends to permit air flow upwardly therethrough, at least one tube bundle mounted generally horizontally within the housing, each having vertically successive, generally horizontal rows of tubes arranged in the direction of air flow therepast, whereby the tubes of the lowermost and uppermost rows are respectively the first and last to be contacted by the air, and the tubes of the rows adjacent to those of each of the first and last to be contacted are the second and next to last to be contacted, respectively, an inlet header adapted to receive the vapor at one end of the bundle and connecting with the tubes of the uppermost row and the row adjacent thereto, a common outlet header at said one end of the bundle connecting directly with the tubes at the lowermost row and the row adjacent thereto for receiving condensate and uncondensed vapor therefrom, means at the other end of the bundle connecting the tubes of said lowermost and uppermost rows to one another and the tubes of said adjacent row to one another, and a fan mounted in the housing and including means for causing air to flow upwardly or downwardly therein.

3. An air cooled condenser for condensing steam or other substantially single component vapor at a pressure near or below atmospheric, comprising a generally upright housing which is open at its upper and lower ends to permit air flow upwardly therethrough, at least one tube bundle mounted generally horizontally within the housing, each having vertically successive, generally horizontal rows of tubes arranged in the direction of air flow therepast, whereby the tubes of the lowermost and uppermost rows are respectively the first and last to be contacted by the air, and the tubes of the rows adjacent to those of each of the first and last to be contacted are the second and next to the last to be contacted, respectively, an inlet header adapted to receive the vapor at one end of the bundle and connecting with the tubes of the uppermost row and the row adjacent thereto, a common outlet header at said one end of the bundle connecting directly with the tubes at the lowermost row and the row adjacent thereto for receiving condensate and uncondensed vapor therefrom, means at the other end of the bundle connecting the tubes of said lowermost and uppermost rows to one another and the tubes of said adjacent row to one another, and a fan mounted in the upper end of the housing above the tube bundle and including means for causing air to flow upwardly or downwardly therein.

* * * * *